US008160473B2

(12) United States Patent
Swartz et al.

(10) Patent No.: US 8,160,473 B2
(45) Date of Patent: Apr. 17, 2012

(54) IMAGING APPARATUS AND METHODS

(75) Inventors: Edwin H. Swartz, Sanford, NC (US); Lynton R. Burchette, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 448 days.

(21) Appl. No.: 12/338,344

(22) Filed: Dec. 18, 2008

(65) Prior Publication Data

US 2010/0141715 A1 Jun. 10, 2010

Related U.S. Application Data

(60) Provisional application No. 61/120,672, filed on Dec. 8, 2008.

(51) Int. Cl.
*G03G 21/18* (2006.01)
*B41J 2/175* (2006.01)

(52) U.S. Cl. ..... 399/109; 347/19; 347/86

(58) Field of Classification Search ..... 347/7, 19, 347/85–87; 399/109
See application file for complete search history.

(56) References Cited

U.S. PATENT DOCUMENTS

| | | | | |
|---|---|---|---|---|
| 5,788,388 | A | 8/1998 | Cowger et al. | |
| 7,136,607 | B1 | 11/2006 | Miller | |
| 7,237,881 | B2 * | 7/2007 | Hayasaki et al. | 347/86 |
| 7,424,245 | B2 * | 9/2008 | Burchette et al. | 399/109 |
| 7,689,144 | B2 * | 3/2010 | Martin et al. | 399/109 |
| 7,917,056 | B2 * | 3/2011 | Burchette et al. | 399/109 |
| 2005/0219303 | A1 * | 10/2005 | Matsumoto et al. | 347/19 |
| 2007/0014577 | A1 | 1/2007 | Austerlitz et al. | |
| 2007/0297828 | A1 | 12/2007 | Causey et al. | |
| 2008/0003014 | A1 | 1/2008 | Martin et al. | |
| 2008/0304858 | A1 * | 12/2008 | Martin et al. | 399/109 |

OTHER PUBLICATIONS

International Search Report for PCT/US2009/67068.
Written Opinion of the International Searching Authority for PCT/US2009/67068.

* cited by examiner

*Primary Examiner* — Huan Tran

(57) ABSTRACT

A method of modifying an imaging cartridge detachably mountable to an imaging apparatus, the imaging cartridge comprising a cartridge chip, the method including detaching the cartridge chip from the imaging cartridge, the cartridge chip comprising a light emitting device adapted for emitting light in the visible spectrum; and attaching a replacement cartridge chip to the imaging cartridge, the replacement cartridge chip comprising a light emitting device adapted for emitting light outside the visible spectrum.

14 Claims, 8 Drawing Sheets

IMAGING APPARATUS AND METHODS

The present application claims the benefit of U.S. Provisional Application Ser. No. 61/120,672 filed Dec. 8, 2008, which is incorporated by reference herein in its entirety.

BACKGROUND

The present invention generally relates to manufacturing, remanufacturing and repairing replaceable imaging components, and more particularly to techniques for manufacturing or remanufacturing a replaceable imaging cartridge such as an inkjet cartridge including a memory element and a light emitting device.

In the imaging industry, there is a growing market for the remanufacture and refurbishing of various types of replaceable imaging components such as toner cartridges, inkjet cartridges, and the like. Imaging cartridges, once spent, are unusable for their originally intended purpose. Without a refurbishing process, these cartridges would simply be discarded, even though the cartridge itself may still have potential life. As a result, techniques have been developed to remanufacture imaging cartridges. These processes may entail, for example, the disassembly of the various structures of the cartridge, replacing toner or ink, cleaning, adjusting or replacing any worn components and reassembling the cartridge.

Some imaging cartridges may include a chip having a memory device which is used to store data related to the cartridge or an imaging device, such as a printer, for example. The printer reads this data to determine certain printing parameters and communicate information to the user. For example, the memory may store the model number of the cartridge so that the printer may recognize the cartridge as one which is compatible with that particular printer. Additionally, by way of example, the cartridge memory may store the number of pages that can be expected to be printed from the cartridge during a life cycle of the cartridge and other useful data. The printer may also write certain data to the memory device, such as the amount of ink or toner remaining in the cartridge. Other data stored in the cartridge may relate to the usage history of the imaging cartridge. The chip may also include a light emitting diode for transmitting light in the visible spectrum. During the remanufacturing process, it may be desirable or necessary to replace the chip to maintain or improve upon the functionality and reporting capabilities of the imaging cartridge. Additionally, for a new, compatible cartridge, it may be desirable to install a chip which improves upon the functionality of the chip provided by an OEM.

SUMMARY

In accordance with one aspect of the present invention, a method of modifying an imaging cartridge detachably mountable to an imaging apparatus, the imaging cartridge comprising a cartridge chip, the method including detaching the cartridge chip from the imaging cartridge, the cartridge chip comprising a light emitting device adapted for emitting light in the visible spectrum; and attaching a replacement cartridge chip to the imaging cartridge, the replacement cartridge chip comprising a light emitting device adapted for emitting light outside the visible spectrum.

In another aspect of the present invention, the light emitting device for emitting light in the visible spectrum emits visible light towards at least one of a photoreceptor of the imaging apparatus and a user to provide the user with information.

In another aspect of the present invention, the light emitting device adapted for emitting light outside the visible spectrum emits light outside the visible spectrum towards at least one of a photoreceptor of the imaging apparatus and a user, the light outside the visible spectrum not visible to the user.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for manufacturing, repairing or remanufacturing an inkjet cartridge having a cartridge chip are disclosed. Other embodiments having different structures and operations for the repair of other types of replaceable imaging components and for various types of imaging devices do not depart from the scope of the present invention.

Figure 1:
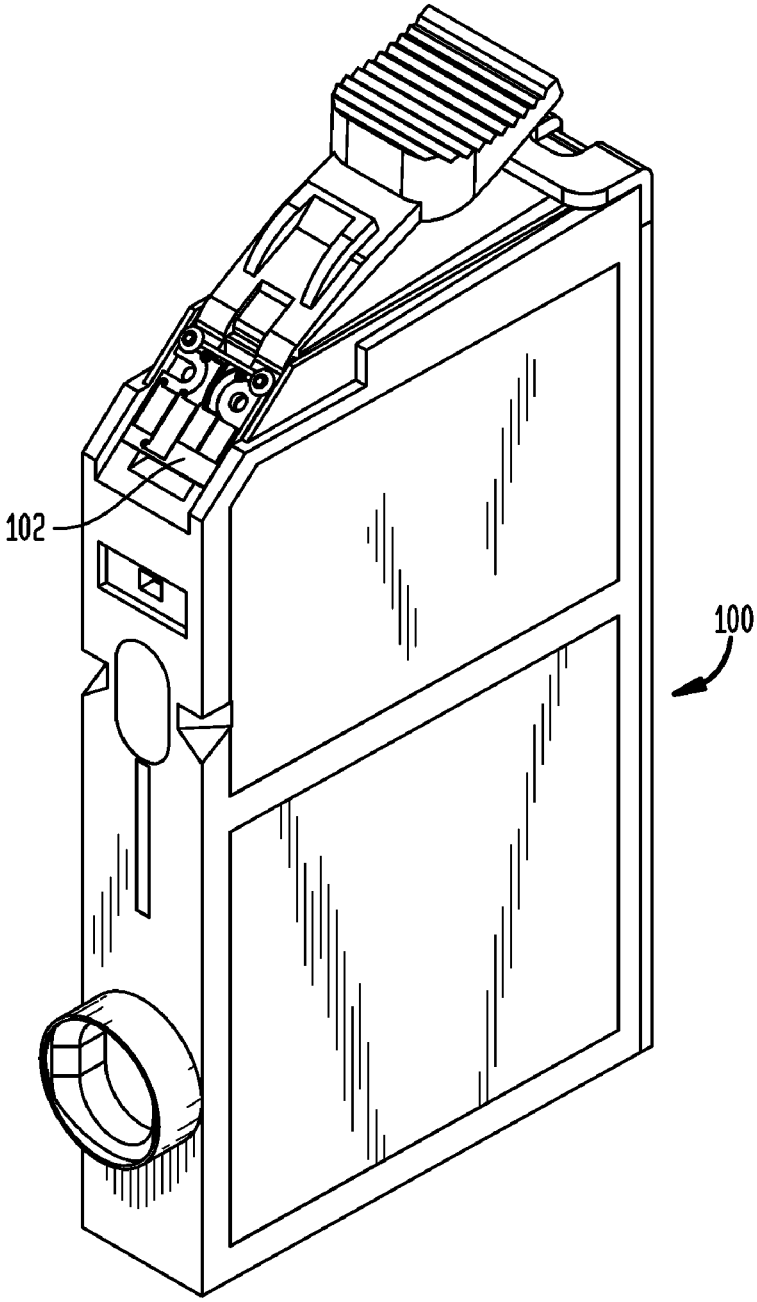
FIG. 1 (PRIOR ART)
FIG. 1 shows a perspective view of a prior art inkjet cartridge with a chip having a light emitting diode which emits visible light.
Figure 2A:
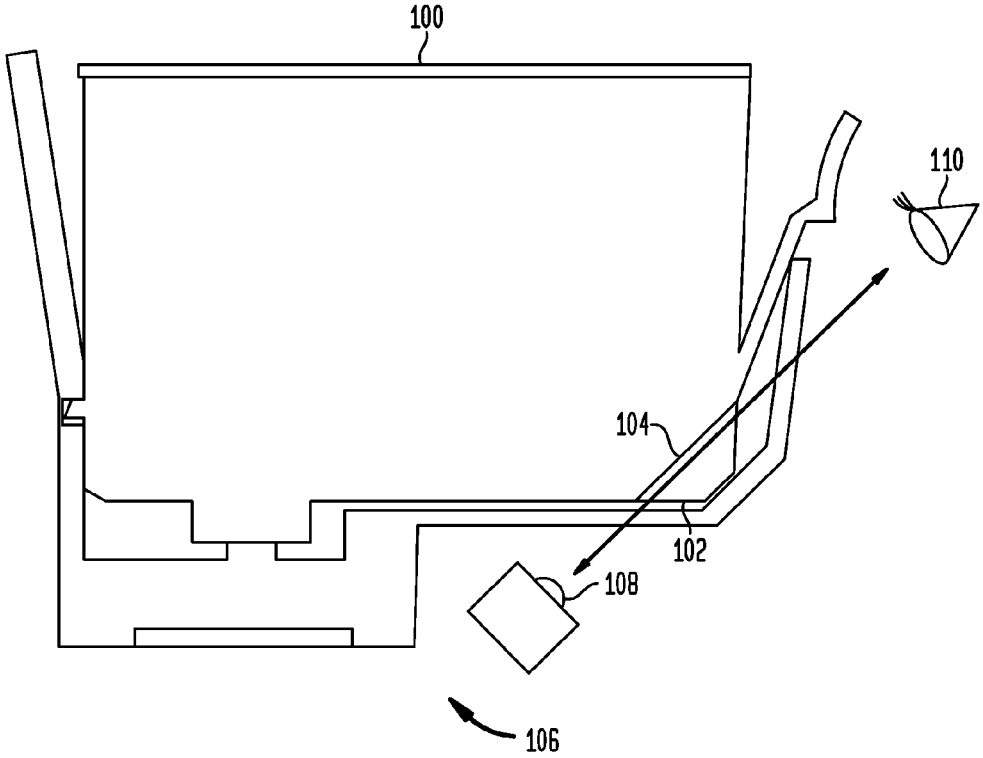
FIG. 2A (PRIOR ART)
FIGS. 2A and 2B show side views of prior art inkjet cartridges mounted in a carriage of an inkjet printer.
Figure 2B:
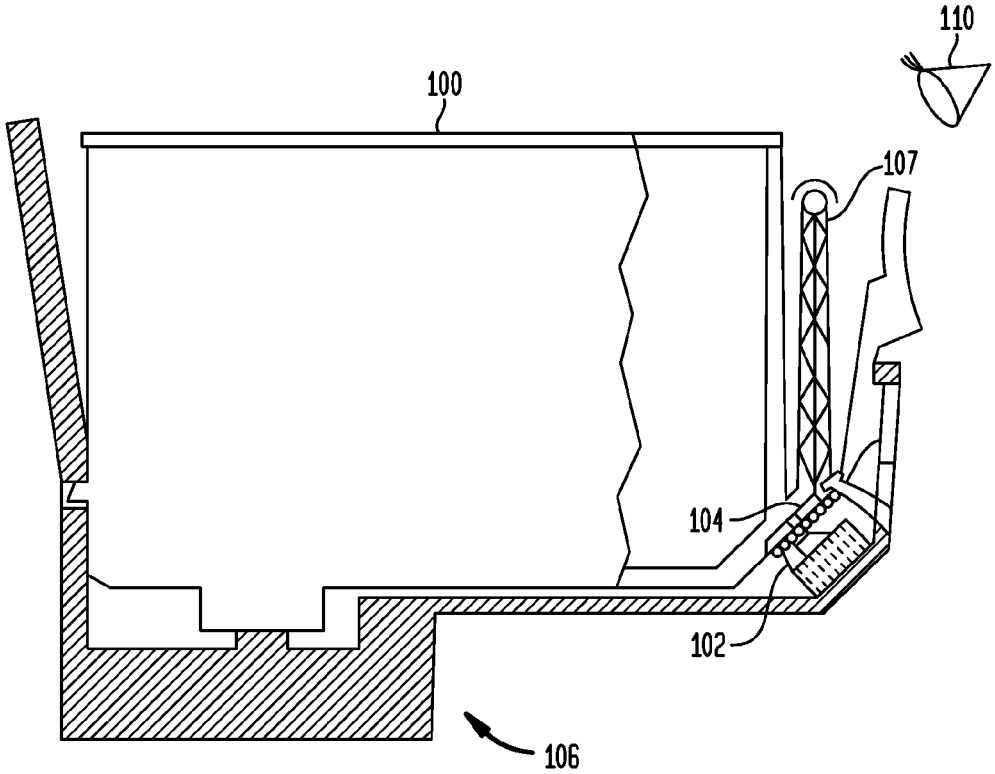
FIG. 2B (PRIOR ART)

FIG. 1 illustrates a perspective view of a prior art inkjet cartridge 100 including a cartridge chip ("chip") 102 having a light emitting diode 104 which emits light in the visible portion of the electromagnetic spectrum. As shown in FIGS. 2A and 2B, the light emitting diode 104 is disposed on the side of the chip 102 facing the cartridge 100. The visible spectrum may be generally considered to be light having wavelengths in the range of 380 nm to 750 nm through air. U.S. Pat. No. 7,237,881 and U.S. Patent Publication No. 2005/0219303, both of which are herein incorporated by reference in their entirety, disclose exemplary inkjet cartridges having light emitting diodes which emit light in the visible spectrum.

FIG. 2A illustrates a side view of the inkjet cartridge 100 when mounted in a carriage 106 of an inkjet printer, or imaging apparatus. When installed in the inkjet printer, the printer can communicate with the cartridge 100 through an electrical bus and command the activation of the light emitting diode 104. The light emitting diode 104 emits visible light towards a photoreceptor 108 of the inkjet printer to communicate information to the inkjet printer and/or towards a user 110 of the inkjet printer to communicate information to the user 110. For example, the light emitting diode 104 may be illuminated constantly to indicate a normal condition, be illuminated with a slow pulse to indicate a low ink level, and be illuminated with a fast pulse to indicate an out of ink condition. FIG. 2B illustrates a side view of an alternate embodiment of the inkjet cartridge 100 in which the visible light from the light emitting diode 104 is not directly observable by the user, but is directed through a light conduit 107 which will glow, or emit the visible light. Further details of such a system are found in Appendix A.

Figure 3:
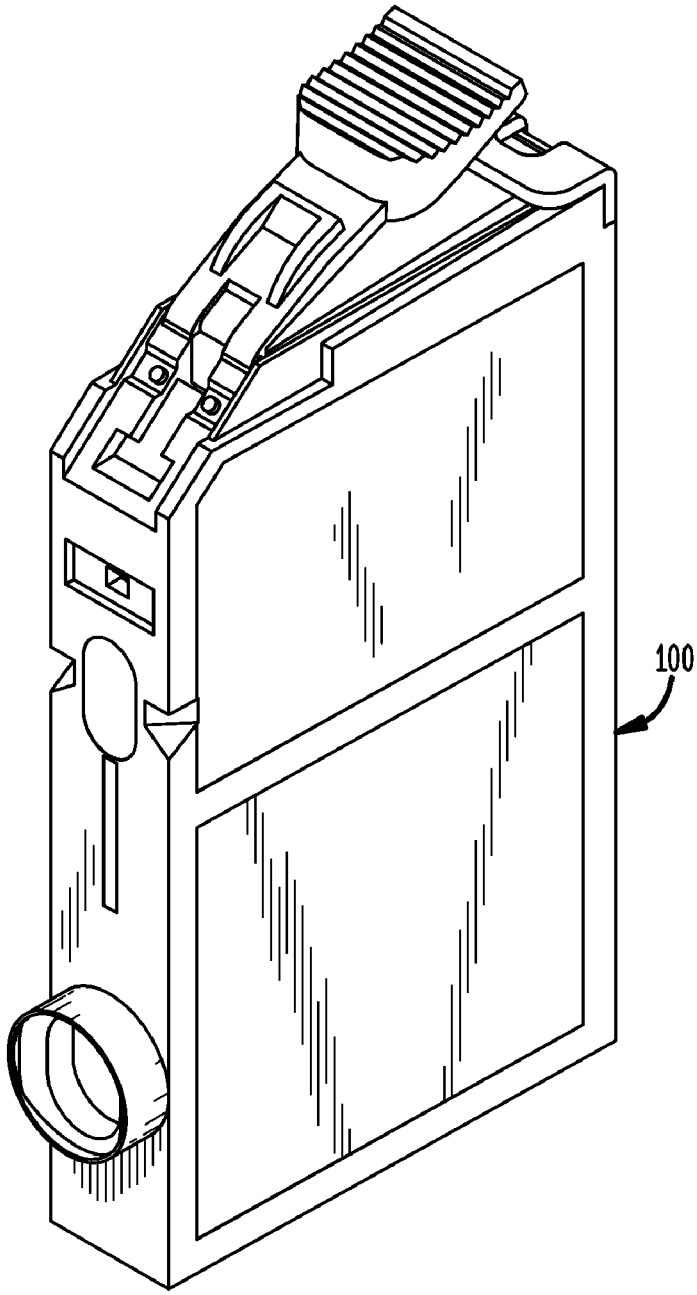
FIG. 3 (PRIOR ART)
FIG. 3 shows a perspective view of a prior art inkjet cartridge with the chip having the light emitting diode which emits visible light removed.

During the remanufacturing of the inkjet cartridge 100, the chip 102 having the visible light emitting diode 104 may be removed, by prying or some other suitable technique, in order to be replaced with a replacement chip. FIG. 3 shows the inkjet cartridge 100 with the chip 102 having the light emitting diode after removal.

Figure 4:
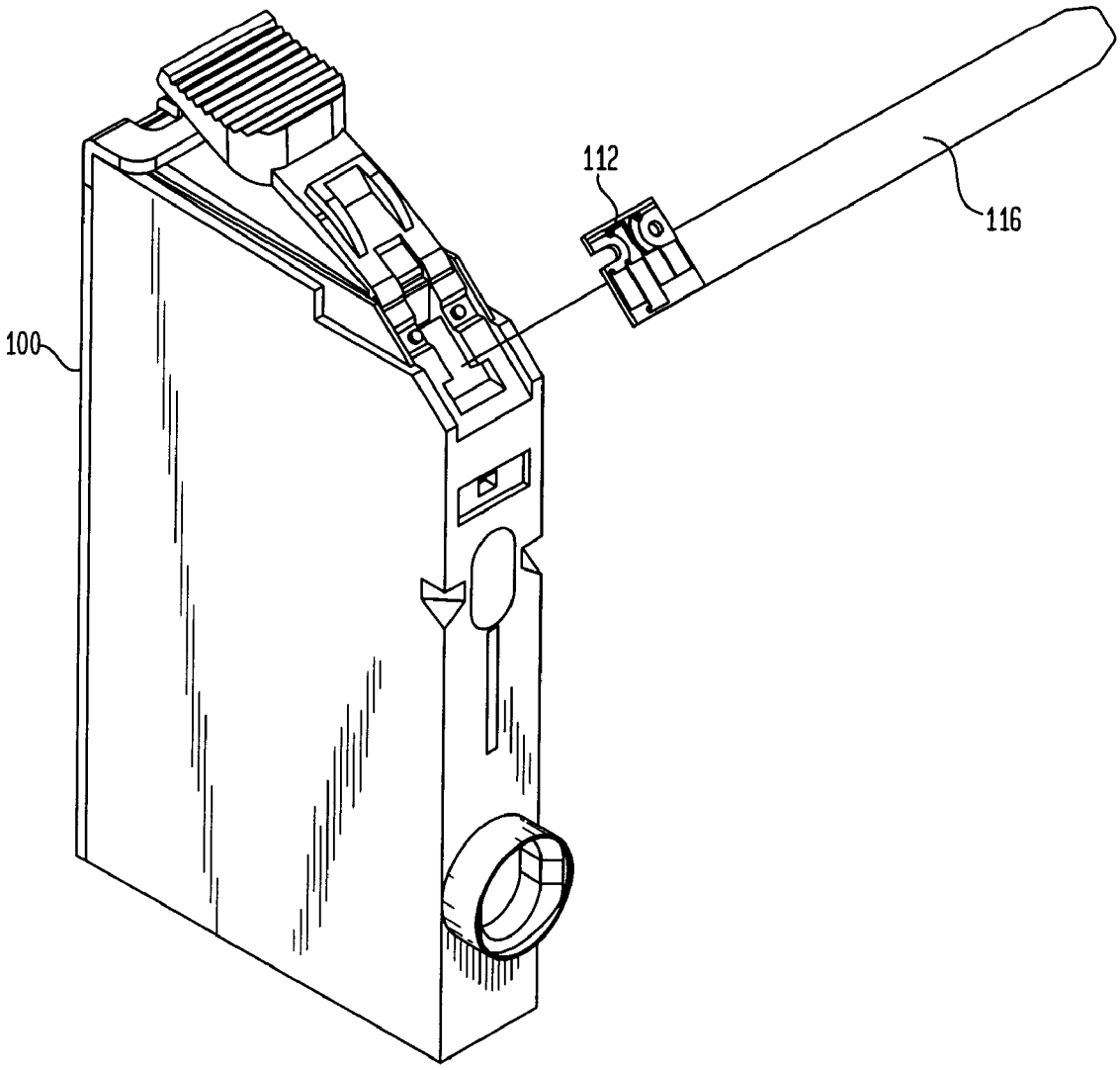
FIG. 4 shows a perspective view of a perspective view of the installation of a replacement chip having a light emitting source which emits light outside the visible spectrum.
Figure 5:
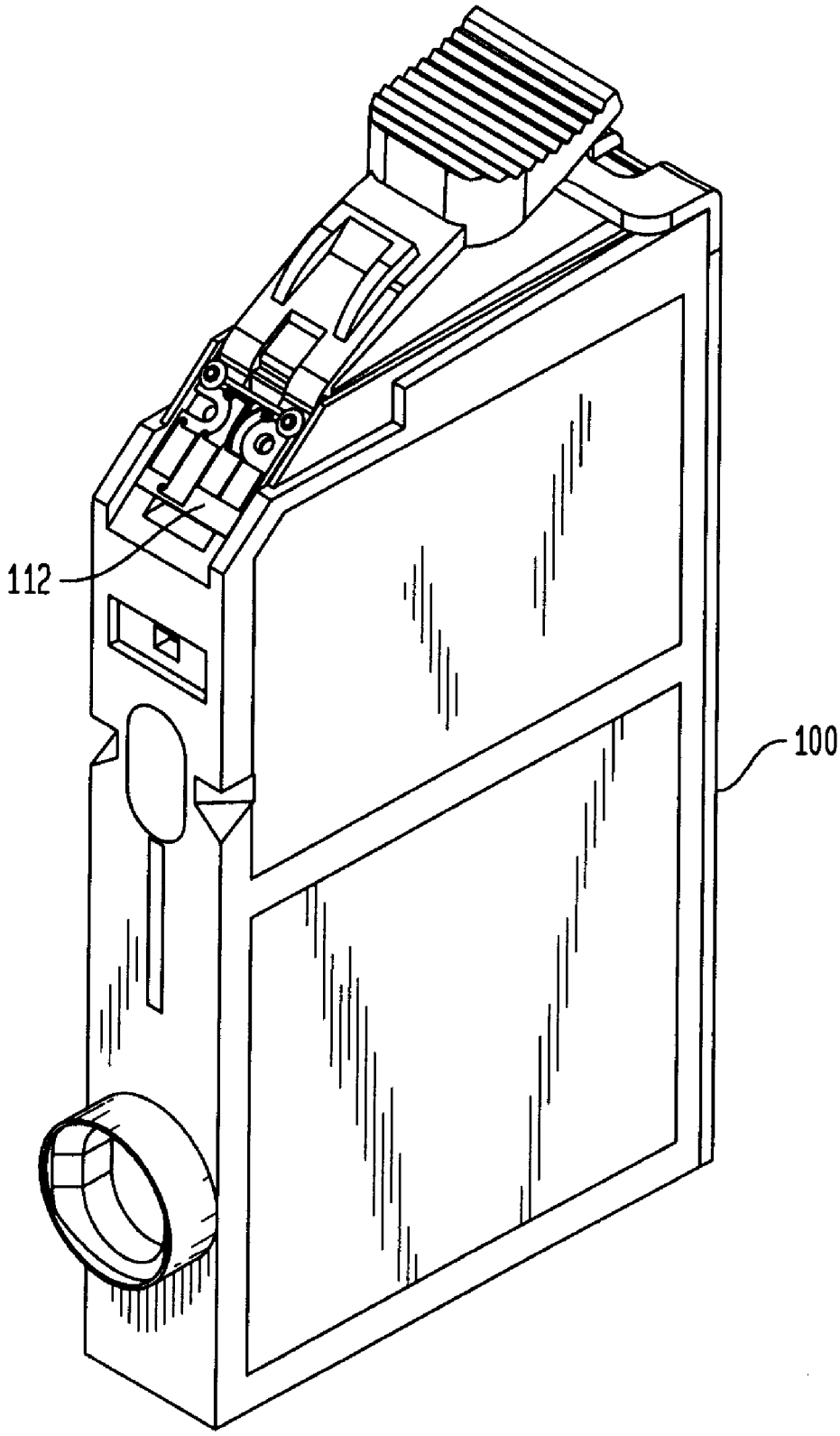
FIG. 5 shows a perspective view of an inkjet cartridge with the replacement chip having a light emitting source which emits light outside the visible spectrum is installed.

A variety of techniques may be used to install a replacement cartridge chip 112 on the inkjet cartridge 100. For example, as shown in FIG. 4, the replacement cartridge chip 112 may be adhered to an installation handle 116 by an adhesive layer on the rear of the replacement cartridge chip 112. FIG. 4 shows a perspective view of the replacement cartridge chip 112 positioned for attachment to the inkjet cartridge 100. The installation handle 116 is used to maneuver the replacement cartridge chip 112 into place and then removed to expose the adhesive layer on the rear of the chip 112, attaching the chip 112 to the inkjet cartridge 100. The inkjet cartridge 100 with the attached replacement cartridge chip 112 is illustrated in FIG. 5. Other techniques for attaching replacement chips are described in U.S. patent application Ser. No. 12/183,561 filed on Jul. 31, 2008 which is herein incorporated by reference in its entirety.

As described in more detail below, the replacement cartridge chip 112 includes the light emitting device 114 adapted for emitting light outside the visible spectrum. Light outside the visible electromagnetic spectrum, also referred to as invisible light, may include infrared (IR) light or ultraviolet (UV) light, for example. The model no. SIR19-21C/TR8 sold by Everlight Electronics Co., Ltd. is one example of an invisible light emitting device suitable for use in conjunction with the present invention. Other exemplary light emitting devices may be the XZTHI53W-1 infrared emitter made by SunLED and the SPH4050 infrared emitter made by OSRAM. This light outside the visible spectrum is used to directly communicate with the photoreceptor of the printer.

Figure 6:
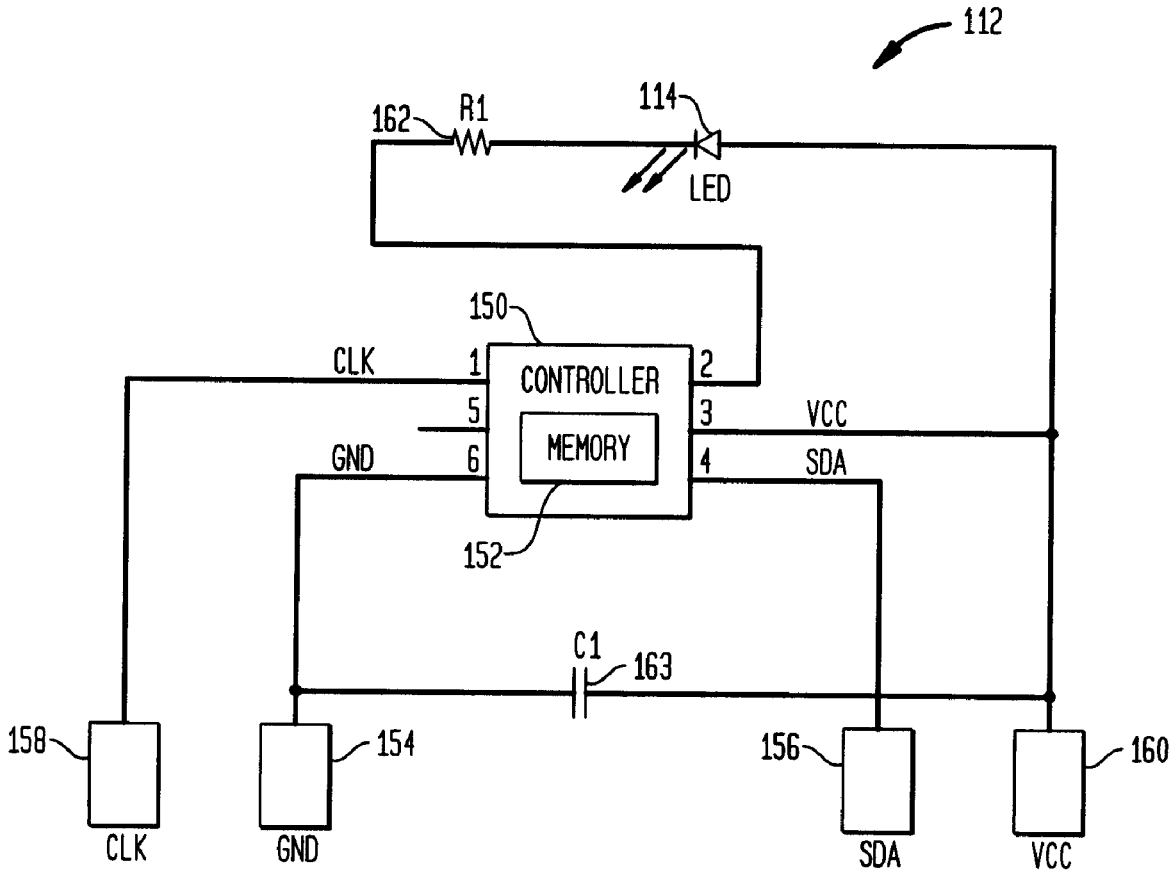
FIG. 6 shows a schematic gram of a cartridge chip having a light emitting device which transmits light outside the visible spectrum.

FIG. 6 illustrates a functional block diagram of the replacement cartridge chip 112. The replacement cartridge chip 112 may suitably comprise a controller 150 having a memory unit 152. The controller 150 provides the appropriate electronic circuitry for communication with an imaging device, such as a printer, through a contact 154 (ground), a contact 156 (data line), a contact 158 (clock signal), and a contact 160 (VCC, or power). Further details of a communication technique which may be used with the present invention may be found in U.S. Pat. No. 7,237,881 and U.S. Patent Publication No. 2005/0219303.

The controller 150 controls the operation of the replacement cartridge chip 112 and provides a functional interface to the memory 152, including controlling the reading of data from and the writing of data to the memory 152 by the printer. The data read from or written to the replacement cartridge chip 112 may include a variety of data. Through the contacts 154, 156, 158 and 160, the controller interfaces to the printer. The controller 150 may be suitably implemented as a custom or semi-custom integrated circuit, a programmable gate array, a microprocessor executing instructions from the memory 152 or other memory, a microcontroller, or any other type of circuitry and/or software, for example. The replacement cartridge chip 112 also includes the invisible-light emitting device 114 connected to the controller 150 through a resistor 162. The resistor 162 may range from 360 ohms to 1000 ohms, for example. The controller 150 determines when the invisible-light emitting device 114 is turned on or off, based in part on commands received from the imaging device through the contacts 154, 156, 158 and 160. A capacitor 163 of 0.1 micro-Farads may be connected between ground and the power line. Such modules described above may be suitably mounted to a printed circuit board to form the universal cartridge chip 112.

Figure 7:
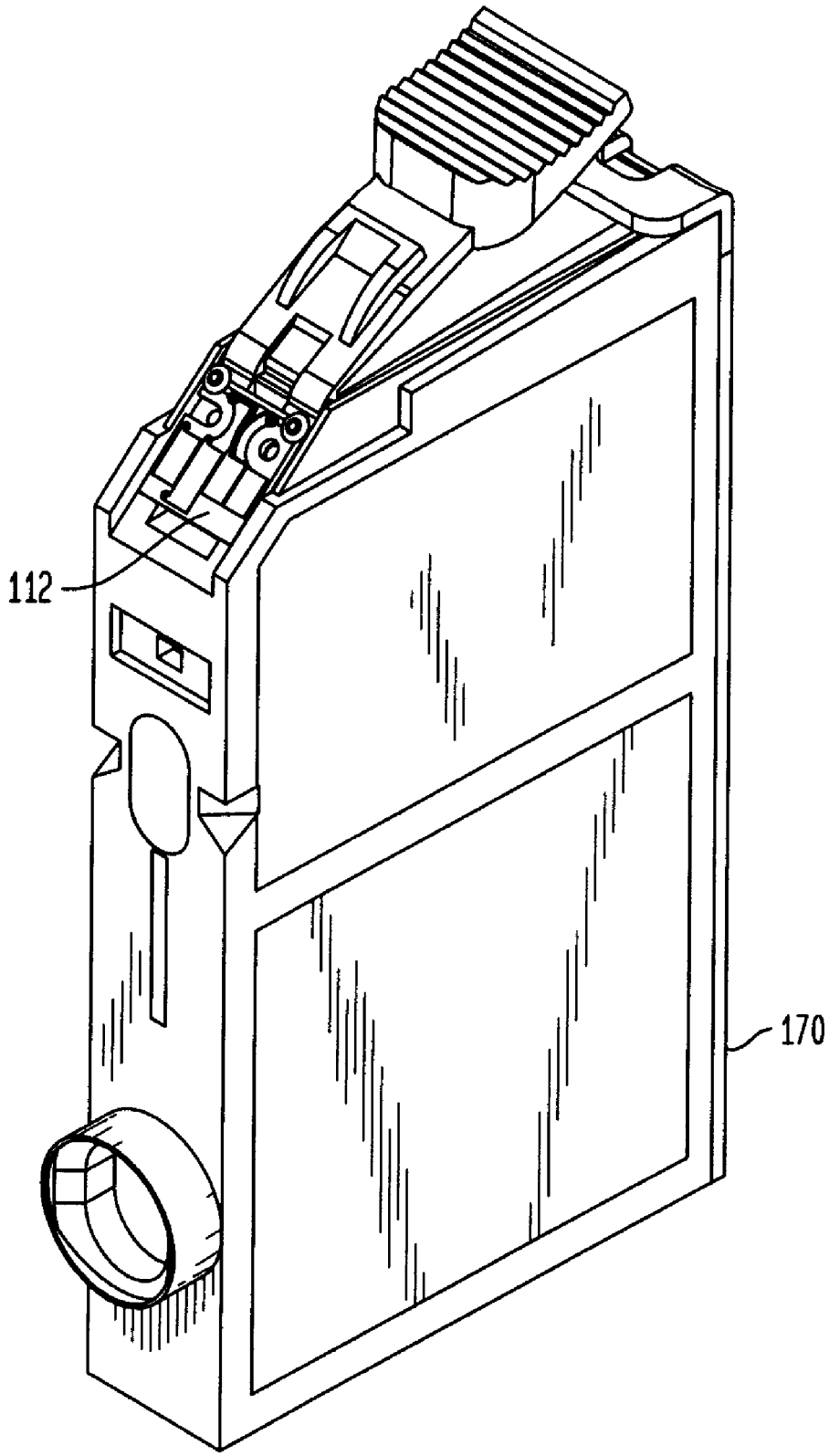
FIG. 7 shows a perspective view of a new compatible inkjet cartridge with a chip having a light emitting source which emits light outside the visible spectrum is installed.

In addition to being used to with remanufactured inkjet cartridges, the cartridge chip 112 may be attached to new, compatible inkjet cartridges. FIG. 7 shows the cartridge chip 112 with the invisible-light emitting device 114 attached to a new, compatible inkjet cartridge 170.

Although specific embodiments have been illustrated and described herein, those of ordinary skill in the art will appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying an imaging cartridge detachably mountable to an imaging apparatus, the imaging cartridge comprising a cartridge chip, the method comprising:

detaching the cartridge chip from the imaging cartridge, the cartridge chip comprising a light emitting device adapted for emitting light in the visible spectrum; and attaching a replacement cartridge chip to the imaging cartridge, the replacement cartridge chip comprising a light emitting device adapted for emitting light outside the visible spectrum.

2. The method of claim 1 wherein when the imaging cartridge is mounted in an imaging apparatus the light emitting device for emitting light in the visible spectrum emits visible light towards at least one of a photoreceptor of the imaging apparatus and a user to provide the user with information.

3. The method of claim 2 wherein the light emitting device adapted for emitting light outside the visible spectrum emits light outside the visible spectrum towards at least one of a photoreceptor of the imaging apparatus and a user, the light outside the visible spectrum is not visible to the user.

4. The method of claim 3 wherein the light emitted outside the visible spectrum is infrared light.

5. The method of claim 3 wherein the light emitted outside the visible spectrum is ultraviolet light.

6. A method for reusing an imaging cartridge detachably mountable to an imaging apparatus, the imaging cartridge having a chip, the method comprising:

removing a chip from an imaging cartridge, wherein the chip includes a light emitting device that when activated emits light in the visible spectrum; and attaching a replacement chip on the imaging cartridge, wherein the replacement chip includes a light emitting device that when activated emits light outside the visible spectrum.

7. The method of claim 6 futher comprising:

mounting the imaging cartridge in an imaging apparatus, wherein when activated by the imaging apparatus the replacement chip emits light outside the visible spectrum towards at least one of a photoreceptor of the imaging apparatus and a user.

8. The method of claim 6, wherein the emitted light can be detected by the photoreceptor and is not visible to the user.

9. The method of claim 6, wherein the emitted light is infrared light.

10. The method of claim 6, wherein the emitted light is ultraviolet light.

11. An imaging cartridge detachably mountable to an imaging apparatus, the imaging apparatus having at least one receptor for detecting light emitted from an imaging cartridge mounted therein and the receptor is designed to receive light in the visible spectrum, the imaging cartridge comprising:

an outer body defining a container for holding an imaging material therein;

a chip attached to the outer body, wherein the chip includes a controller having a memory unit and a light emitting device that when activated emits light outside the visible spectrum; and an electrical contact disposed on the outer body, wherein when the imaging cartridge is mounted in an imaging apparatus the electrical contact provides communication between the chip and the imaging apparatus, wherein the imaging apparatus sends communication signals to the imaging cartridge and the controller activates the light emitting device in response to the communication signals causing the light emitting device to emit light that is outside the visible spectrum.

12. The imaging cartridge of claim 11, wherein the imaging material is a liquid material.

13. The imaging cartridge of claim 11 further comprising an installation handle on the outer body, wherein the chip is attached to outer body on the installation via an adhesive material.

14. The imaging cartridge of claim 11, wherein the imaging device includes a receptor for detecting light emitted from the light emitting device and the imaging device determines that the light emitting device is activated when the receptor detects light emitted from the light emitting device.

* * * * *